US005320742A

United States Patent [19]

Fletcher et al.

[11] Patent Number: 5,320,742

[45] Date of Patent: Jun. 14, 1994

[54] GASOLINE UPGRADING PROCESS

[75] Inventors: David L. Fletcher, Turnersville; Timothy L. Hilbert, Sewell; David A. Pappal, Haddonfield, all of N.J.; David W. Rumsey, Plainfield, Ill.; Gerald J. Teitman, Vienna, Va.

[73] Assignee: Mobil Oil Corporation, Fairfax, Va.

[21] Appl. No.: 963,229

[22] Filed: Oct. 19, 1992

Related U.S. Application Data

[63] Continuation-in-part of Ser. No. 850,106, Mar. 12, 1992, which is a continuation-in-part of Ser. No. 745,311, Aug. 15, 1991.

[51] Int. Cl.[5] ..... C10G 35/00; C10G 45/00

[52] U.S. Cl. ..... 208/89; 208/92; 208/211; 208/212; 208/60

[58] Field of Search ..... 208/89, 59, 60, 92, 208/211, 212

[56] References Cited

U.S. PATENT DOCUMENTS

| | | | |
|---|---|---|---|
| 3,729,409 | 4/1973 | Chen | 208/135 |
| 3,759,821 | 9/1973 | Brennan et al. | 208/93 |
| 3,767,568 | 10/1973 | Chen | 208/134 |
| 3,923,641 | 12/1975 | Morrison | 208/111 |
| 3,957,625 | 5/1976 | Orkin | 208/211 |
| 4,049,542 | 9/1977 | Gibson et al. | 208/213 |
| 4,062,762 | 12/1977 | Howard et al. | 208/211 |
| 4,738,766 | 4/1988 | Fischer et al. | 208/68 |
| 4,753,720 | 6/1988 | Morrison | 208/135 |
| 4,827,076 | 5/1989 | Kokayeff et al. | 208/13 |
| 5,143,596 | 9/1992 | Maxwell et al. | 208/89 |

*Primary Examiner*—Helane Myers

*Attorney, Agent, or Firm*—A. J. McKillop; M. D. Keen

[57] ABSTRACT

A sulfur-containing catalytically cracked naphtha is upgraded to form a low-sulfur gasoline product by a process which retains the octane contribution from the olefinic front end of the naphtha. Initially, the mercaptan sulfur in the front end of the cracked naphtha is converted to higher boiling disulfides by oxidation. The front end, which is then essentially an olefinic, high octane sulfur-free material, may be blended directly into the gasoline pool. The back end, which now contains the original higher boiling sulfur components such as thiophenes, together with the sulfur transferred from the front end as disulfides, is hydrotreated to produce a desulfurized product. This desulfurized product, which has undergone a loss in octane by saturation of olefins, is then treated in a second stage, by contact with a catalyst of acidic functionality, preferably a zeolite such as ZSM-5, under conditions which produce a product in the gasoline boiling range of higher octane value. Because this second product may contain combined organic sulfur, it may be subjected to a final desulfurization to reduce organic sulfur to acceptable levels.

25 Claims, 1 Drawing Sheet

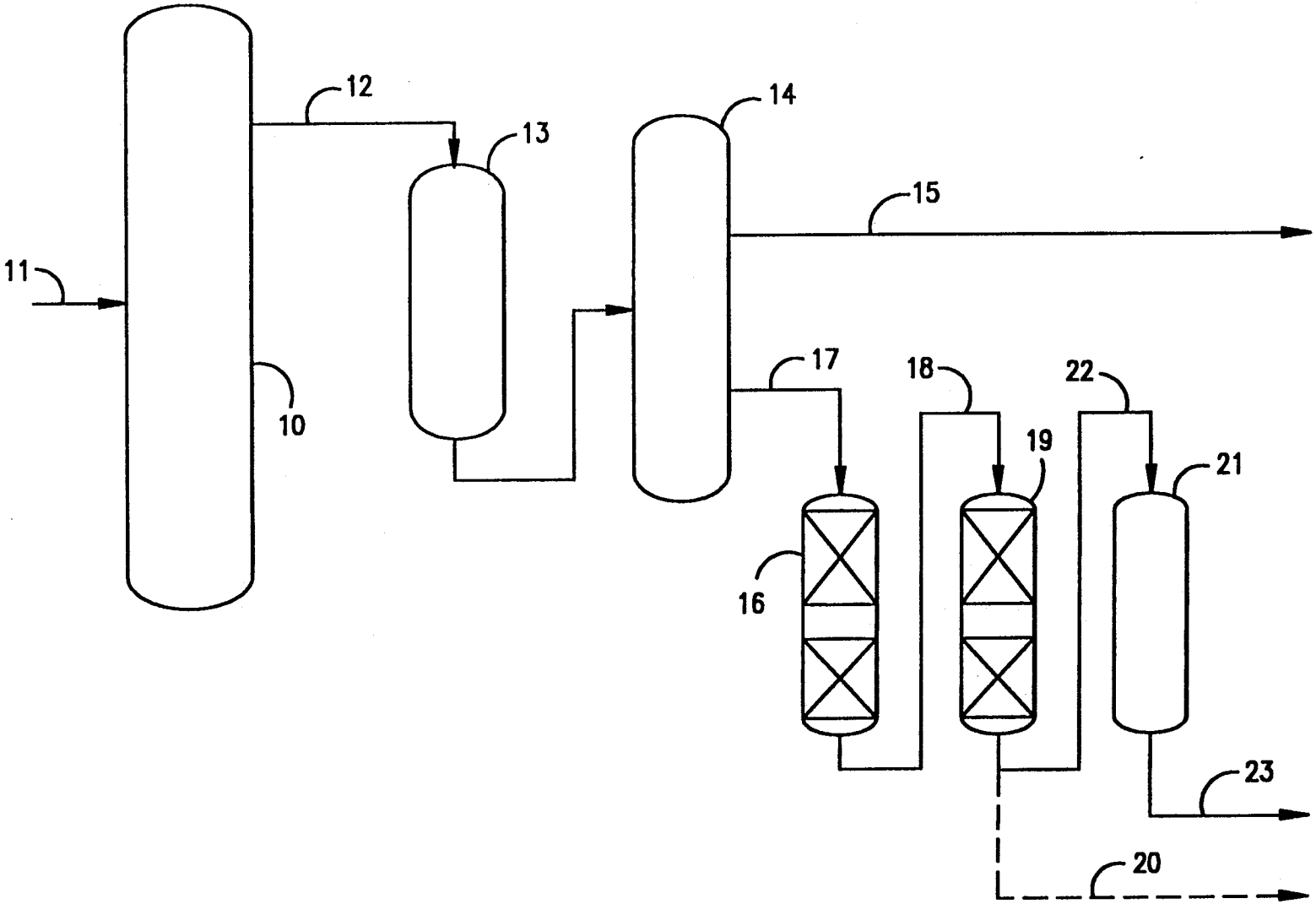
10
11
12
13
14
15
16
17
18
19
20
21
22
23

GASOLINE UPGRADING PROCESS

CROSS REFERENCE TO RELATED APPLICATIONS

This application is a continuation-in-part of our prior application Serial No. 07/850,106, filed 12 Mar. 1992, which, in turn, is a continuation-in-part of our prior application Ser. No. 07/745,311, filed 15 Aug. 1991. It is also a continuation-in-part of Ser. No. 07/745,311.

FIELD OF THE INVENTION

This invention relates to a process for the upgrading of hydrocarbon streams. It more particularly refers to a process for upgrading gasoline boiling range petroleum fractions containing substantial proportions of sulfur impurities.

BACKGROUND OF THE INVENTION

Catalytically cracked gasoline currently forms a major part of the gasoline product pool in the United States and it provides a large proportion of the sulfur in the gasoline. The sulfur impurities may require removal, usually by hydrotreating, in order to comply with product specifications or to ensure compliance with environmental regulations, both of which are expected to become more stringent in the future, possibly permitting no more than about 300 ppmw sulfur in motor gasolines; low sulfur levelss result in reduced emissions of CO, $NO_x$ and hydrocarbons.

Naphthas and other light fractions such as heavy cracked gasoline may be hydrotreated by passing the feed over a hydrotreating catalyst at elevated temperature and somewhat elevated pressure in a hydrogen atmosphere. One suitable family of catalysts which has been widely used for this service is a combination of a Group VIII and a Group VI element, such as cobalt and molybdenum, on a substrate such as alumina. After the hydrotreating operation is complete, the product may be fractionated, or simply flashed, to release the hydrogen sulfide and collect the now sweetened gasoline.

Cracked naphtha, as it comes from the catalytic cracker and without any further treatments, such as purifying operations, has a relatively high octane number as a result of the presence of olefinic components. In some cases, this fraction may contribute as much as up to half the gasoline in the refinery pool, together with a significant contribution to product octane. Hydrotreating of any of the sulfur containing fractions which boil in the gasoline boiling range causes a reduction in the olefin content, and consequently a reduction in the octane number and as the degree of desulfurization increases, the octane number of the normally liquid gasoline boiling range product decreases. Some of the hydrogen may also cause some hydrocracking as well as olefin saturation, depending on the conditions of the hydrotreating operation.

Various proposals have been made for removing sulfur while retaining the more desirable olefins. The sulfur impurities tend to concentrate in the heavy fraction of the gasoline, as noted in U.S. Pat. No. 3,957,625 (Orkin) which proposes a method of removing the sulfur by hydrodesulfurization of the heavy fraction of the catalytically cracked gasoline so as to retain the octane contribution from the olefins which are found mainly in the lighter fraction. In one type of conventional, commercial operation, the heavy gasoline fraction is treated in this way. As an alternative, the selectivity for hydrodesulfurization relative to olefin saturation may be shifted by suitable catalyst selection, for example, by the use of a magnesium oxide support instead of the more conventional alumina.

U.S. Pat. No. 4,049,542 (Gibson) discloses a process in which a copper catalyst is used to desulfurize an olefinic hydrocarbon feed such as catalytically cracked light naphtha. This catalyst is stated to promote desulfurization while retaining the olefins and their contribution to product octane.

In any case, regardless of the mechanism by which it happens, the decrease in octane which takes place as a consequence of sulfur removal by hydrotreating creates a tension between the growing need to produce gasoline fuels with higher octane number and—because of current ecological considerations—the need to produce cleaner burning, less polluting fuels, especially low sulfur fuels. This inherent tension is yet more marked in the current supply situation for low sulfur, sweet crudes.

Processes for improving the octane rating of catalytically cracked gasolines have been proposed. U.S. Pat. No. 3,759,821 (Brennan) discloses a process for upgrading catalytically cracked gasoline by fractionating it into a heavier and a lighter fraction and treating the heavier fraction over a ZSM-5 catalyst, after which the treated fraction is blended back into the lighter fraction. Another process in which the cracked gasoline is fractionated prior to treatment is described in U.S. Pat. No. 4,062,762 (Howard) which discloses a process for desulfurizing naphtha by fractionating the naphtha into three fractions each of which is desulfurized by a different procedure, after which the fractions are recombined.

The octane rating of the gasoline pool may be increased by other methods, of which reforming is one of the most common. Light and full range naphthas can contribute substantial volume to the gasoline pool, but they do not generally contribute significantly to higher octane values without reforming. They may, however, be subjected to catalytically reforming so as to increase their octane numbers by converting at least a portion of the paraffins and cycloparaffins in them to aromatics. Fractions to be fed to catalytic reforming, for example, with a platinum type catalyst, need to be desulfurized before reforming because reforming catalysts are generally not sulfur tolerant; they are usually pretreated by hydrotreating to reduce their sulfur content before reforming. The octane rating of reformate may be increased further by processes such as those described in U.S. Pat. Nos. 3,767,568 and 3,729,409 (Chen) in which the reformate octane is increased by treatment of the reformate with ZSM-5.

Aromatics are generally the source of high octane number, particularly very high research octane numbers and are therefore desirable components of the gasoline pool. They have, however, been the subject of severe limitations as a gasoline component because of possible adverse effects on the ecology, particularly with reference to benzene. It has therefore become desirable, as far as is feasible, to create a gasoline pool in which the higher octanes are contributed by the olefinic and branched chain paraffinic components, rather than the aromatic components.

In our co-pending applications Ser. Nos. 07/850,106, filed 12 Mar. 1992, and Ser. No. 07/745,311, filed 15 Aug. 1991, we have described a process for the upgrading of gasoline by sequential hydrotreating and selective cracking steps. In the first step of the process, the naphtha is desulfurized by hydrotreating and during this step some loss of octane results from the saturation of olefins. The octane loss is restored in the second step by a shape-selective cracking, preferably carried out in the presence of an intermediate pore size zeolite such as ZSM-5. The product is a low-sulfur gasoline of good octane rating. Reference is made to Ser. Nos. 07/735,311 and 07/850,106 for a detailed description of this process.

While the olefins in the cracked gasolines are mainly in the front end of these fractions, the sulfur-containing impurities tend to be concentrated in the back end, mainly as thiophenes and other heterocyclic compounds, although front end sulfur is also encountered in the form of mercaptans and must be removed in order to produce an acceptable product. The desulfurization which takes place during the hydrodesulfurization step is accompanied by saturation of the olefins; although the resulting loss in product octane is restored in the second step of the process, it would clearly be desirable to reduce the olefin saturation as much as possible so as to retain octane while, at the same time, achieving the desired degree of desulfurization.

SUMMARY OF THE INVENTION

We have now devised a process scheme which enables the desulfurization to be carried out in a way which reduces the saturation of the olefins. This is done by selectively transferring the mercaptan sulfur components from the olefin-rich front end of the naphtha to the back end and then carrying out the desulfurization on the back end. The mercaptans may be separated from the olefins in the front end of the naphtha by oxidizing the mercaptans to disulfides which, being higher boiling than than the mercaptans, can be separated from the olefin-rich front end by a simple fractionation. The olefin-containing fraction, free of mercaptan sulfur, may then be passed directly to the gasoline pool while the higher boiling fraction is desulfurized by hydrotreating. The octane which is lost by the saturation of the back end olefins during the hydrotreating is then restored by treatment with a catalyst of acidic functionality, to effect a limited degree of cracking, mainly of low-octane components in the hydrotreated fraction. The effluent from this step may then be passed to the gasoline pool or, if necessary, be subjected to a final desulfurization to remove any mercaptan sulfur formed by recombination reactions in the final cracking step.

The front end of the cracked feed, which is relatively rich in olefins, is spared the saturating effect of the hydrodesulfurization but is nevertheless sweetened by removal of the mercaptans in the oxidation and the subsequent fractionation. This fraction may therefore be passed directly to the refinery gasoline pool following the separation of the sulfur. The mercaptan oxidation transfers the sulfur from the front end to the higher boiling back end which is then treated to remove the sulfur. Because the thiophenes and other high boiling sulfur compounds initially present in this portion of the feed are not amenable to non-hydrogenative removal, the desulfurization is carried out hydrogenatively. The sulfur from thiophenes, substituted thiophenes and other higher boiling sulfur compounds initially present in the higher boiling portion of the feed, together with the disulfides formed by the oxidation of the mercaptans, are converted to inorganic form during this step of the process.

If desired, the sulfur may be removed (as $H_2S$) at this stage and the lost octane restored by treatment with the acidic catalyst. Usually, however, it is more convenient to run the treatment with the acidic catalyst in cascade with the hydrotreating, without interstage separation of the inorganic sulfur and nitrogen. In this case, the sulfur (as $H_2S$) tends to undergo recombination reactions with the olefins formed in the octane restoration step to form mercaptans which may then be removed by passing this hydrotreated, partly cracked fraction to a final desulfurization to remove recombined sulfur. This may be done by an extractive process or by a mild hydrotreating.

According to the present invention, therefore, a sulfur-containing cracked petroleum fraction in the gasoline boiling range is subjected to a mercaptan oxidation to convert sulfur present in the lower boiling portion to higher boiling sulfur compounds, predominantly disulfides. The treated feed is then fractionated to form two or more fractions of differing boiling range. The lower boiling fraction, which is essentially an olefinic, high octane mercaptan-free material, may be blended directly into the gasoline pool. The higher boiling fraction, which now contains the most of the sulfur from the naphtha, is hydrogenatively desulfurized to produce a first desulfurized product containing a lower proportion of combined organic sulfur. This desulfurized product, which has undergone a loss in octane by saturation of olafins, is then treated in a second stage, by contact with a catalyst of acidic functionality under conditions which produce a second product in the gasoline boiling range which is of higher octane value than the first product. Because this second product may contain combined organic sulfur, it may be subjected to a final desulfurization to reduce organic sulfur to acceptable levels.

BRIEF DESCRIPTION OF THE DRAWINGS

In the accompanying drawing the single figure is a simplified process schematic for the present process.

DETAILED DESCRIPTION

Feed

The feed to the process comprises a sulfur-containing petroleum fraction which boils in the gasoline boiling range. Feeds of this type include light naphthas typically having a boiling range of about $C_6$ to 330° F. and full range naphthas typically having a boiling range of about $C_5$ to 420° F. although end points may extend to higher values, for example, up to about 500° F. While the most preferred feed appears at this time to be a heavy gasoline produced by catalytic cracking; or a light or full range gasoline boiling range fraction, the best results are obtained when, as described below, the process is operated with a gasoline boiling range fraction which has a 95 percent point (determined according to ASTM D 86) of at least about 325° F.(163° C.) and preferably at least about 350° F.(177° C.), for example, 95 percent points of at least 380° F. (about 193° C.) or at least about 400° F. (about 220° C.). Because the present process is designed to desulfurize the cracked feed in a way which effectively removes the sulfur across the entire boiling range while retaining olefins, the process may utilize the entire gasoline fraction obtained from the catalytic cracking step. The boiling range of the gasoline fraction will, of course, depend on refinery and market constraints but generally will be within the limits set out above.

The sulfur content of these catalytically cracked fractions will depend on the sulfur content of the feed to the cracker as well as on the boiling range of the selected fraction used as the feed in the process. Lighter fractions, for example, will tend to have lower sulfur contents than the higher boiling fractions. As a practical matter, the sulfur content will exceed 50 ppmw and usually will be in excess of 100 ppmw and in most cases in excess of about 500 ppmw. For the fractions which have 95 percent points over about 380° F. (193° C.), the sulfur content may exceed about 1,000 ppmw and may be as high as 4,000 or 5,000 ppmw or even higher, as shown below. The nitrogen content is not as characteristic of the feed as the sulfur content and is preferably not greater than about 20 ppmw although higher nitrogen levels typically up to about 50 ppmw may be found in certain higher boiling feeds with 95 percent points in excess of about 380° F. (193° C). The nitrogen level will, however, usually not be greater than 250 or 300 ppmw. As a result of the cracking which has preceded the steps of the present process, the feed to the initial combined desulfurization steps will be olefinic, with an olefin content of at least 5 and more typically in the range of 10 to 20, e.g. 15–20, weight percent.

The front end of the cracked naphtha contains most of the high octane olefins but relatively little of the sulfur. The sulfur components which are present are mainly in the form of mercaptans while the sulfur in the back end is present predominantly in non-mercaptan form, mainly as thiophenes, substituted thiophenes and other heterocyclic compounds which are usually resistant to removal by the extractive or chemical oxidation processes which are successful with mercaptans; they are, however, subject to removal by hydrotreatment, usually under relatively mild conditions.

Process Configuration

In the first step of the present processing technique, the olefins in the front end of the sulfur-containing cracked naphtha are separated from the sulfur compounds, predominantly mercaptans, in this olefin-rich fraction. This separation is achieved by selectively transferring the sulfur to the olefin-poor back end: the sulfur compounds are converted to higher boiling disulfide compounds, which may then be separated from the front end olefins by a simple distillation. This effect may be illustrated by reference to Table 1 below which compares the boiling points for the lower mercaptans commonly encountered in the front end of the cracked naphtha with the boiling points for their corresponding disulfides.

TABLE 1

| | Sulfur Compound Boiling Points | |
|---|---|---|
| C No. | BP, Mercaptan, °F. | BP, Disulfide, °F. |
| $C_1$ | 46 | 243 |
| $C_2$ | 96 | 308 |
| i-$C_3$ | 136 | 347 |
| n-$C_3$ | 154 | 378 |
| i-$C_4$ | 190 | 428 |
| n-$C_4$ | 208 | 447 |

The highest boiling mercaptan and the lowest boiling disulfide can be separated readily on the basis of boiling point. If the cracked feed is subjected to a mercaptan oxidation to convert the mercaptan sulfur to disulfides, a subsequent fractionation can be carried out to separate the olefins concentrated in the lower boiling porti on of the cracked naphtha from the sulfur which was initially present in the same boiling range but is now transferred to the back end by conversion to the higher boiling disulfides. By splitting the treated cracked feed at a cut point from about 150° to 240° F. (about 65° to 115° C.), the lower boiling fraction will be essentially mercaptan-free and can be blended directly into the refinery gasoline pool. Usually, the cut point will be between about 170° F. (about 77° C.) and 285° F. (about 141° C.), depending on the amount of thiophenes which must be hydrogenatively desulfurized to achieve product sulfur specifications. For maximum desulfurization, a cut point of about 170° F. (77° C.) cut point will put the thiophenes into the heavy cut but higher product sulfur specifications e.g. 200 ppm, may allow higher cut points, leaving thiophene and possibly $C_1$-thiophenes unreacted but giving better gasoline yields. Higher cut points reduce the volume of the heavy fraction and may therefore permit the size of the hydroprocessing reactors to be reduced as well as reducing process losses.

The hydrogenative desulfurization treatment of the back end results in a saturation of the high octane value olefins present in the higher boiling fraction but this loss is wholly or partially restored in the subsequent shape-selective cracking step. This shape-selective cracking step restores the lost octane by the cracking of low octane components while reducing the carbon number of the hydrocarbons present. Olefins formed during the cracking reactions tend to undergo recombination with the inorganic sulfur released during the hydrotreating, unless an interstage separation of the sulfur is carried out. The product from the octane restoration step may therefore fail the doctor sweet test as a result of the mercaptans formed in these recombination reactions. They may, however, be readily removed to the extent necessary by passing this product to a mercaptan removal step.

The figure provides a simplified process schematic. The cracked material from the FCCU enters a fractionator 10 through inlet 11 and is separated into a number of fractions according to the refinery requirements. The cracked FCC naphtha is withdrawn through line 12 and passes to a mercaptan oxidation (sweetening) unit 13 in which the mercaptans are converted to higher boiling disulfide compounds. The effluent from the mercaptan oxidation unit is then passed to fractionator 14 in which it is split into a higher boiling fraction and a lower boiling fraction with a cut point usually in the range of about 170° to 285° F. (about 77° to 141° C.). The lower boiling cut from fractionator 14 is essentially free of mercaptan compounds but retains the high octane olefin components and is therefore suitable for blending directly into the refinery gasoline pool by way of line 15.

The higher boiling fraction from fractionator 14 is relatively poor in olefins compared to the lower boiling fraction and contains the higher boiling sulfur compounds, including thiophenes and substituted thiophenes together with the disulfides formed by the oxidation of the mercaptans from the front end of the cracked naphtha. This fraction is passed to hydrotreater 16 through line 17 and is desulfurized in hydrotreater 16 in the presence of hydrogen.

The effluent from hydrotreater 16, containing the sulfur in inorganic form (hydrogen sulfide) is passed through line 18 to enter the second stage reactor 19 in which the desulfurized fraction is subjected to a controlled and limited degree of shape-selective cracking to restore the octane loss which takes place in the hydrotreater as a result of olefin saturation. The higher octane product, which now contains some mercaptans formed by $H_2S$/olefin recombination reactions, is withdrawn through line 20. The mercaptans may be removed from this second intermediate product by treatment in an extractive mercaptan removal unit 21, entering by way of line 22. Alternatively, a mild hydrotreatment may be carried out to remove the mercaptan sulfur, although at the cost of some olefin resaturation; to compensate for this, the degree of cracking in the octane restoration step may be increased accordingly. The mercaptan-free product from the final desulfurization is taken out through line 23 for blending into the refinery gasoline pool together with other gasoline components including the light fraction together with straight-run naphtha, alkylate and reformate.

Mercaptan Oxidation

In the initial step of the process, the mercaptans in the front end of the cracked naphtha are separated from the high octane olefins which are concentrated in this fraction. This separation is achieved by transferring the low boiling mercaptan sulfur compounds from the front end to the back end. The low boiling mercaptans are converted to higher boiling disulfides which are then separated from the front-end olefins by distillation.

A number of mercaptan oxidation (sweetening) processes are known and well-established in the petroleum refining industry. Among the mercaptan oxidation processes which may be used are the copper chloride oxidation process, Mercapfining, chelate sweetening and Merox, of which the Merox process is preferred because it may be readily integrated with a mercaptan extraction in the final processing step for the back end.

In the Merox oxidation process, mercaptans are extracted form the feed and then oxidized by air in the caustic phase in the presence of the Merox catalyst, an iron group chelate (cobalt phthalocyanine) to form disulfides which are then redissolved in the hydrocarbon phase, leaving the process as disulfides in the hydrocarbon product. In the copper chloride sweetening process, mercaptans are removed by oxidation with cuptic chloride which is regenerated with air which is introduced with the feed to oxidation step.

Whatever the oxidation process at this stage of the process, the mercaptans are converted to the higher boiling disulfides which are transferred to the higher boiling fraction and subjected to hydrogenative removal together with the thiophene and other forms of sulfur present in the higher boiling portion of the cracked feed.

Mercaptan oxidation processes are described in Modern Petroleum Technology, G. D. Hobson (Ed.), Applied Science Publishers Ltd., 1973, ISBN 085334 487 6, as well as in Petroleum Processing Handbook, Bland and Davidson (Ed.), McGraw-Hill, New York 1967, pages 3–125 to 3–130. The Merox process is described in Oil and Gas Journal 63, No. 1, pp. 90–93 (January 1965). Reference is made to these works for a description of these processes which may be used for converting the lower boiling sulfur components of the front end to higher boiling materials in the back end of the cracked feed.

Fractionation

As noted above, the cracked naphtha feed is separated into two fractions after the mercaptan sulfur has been transferred to the back end by the oxidation. By selecting a cut point between the two fractions no higher than about 170° F. (about 65° C.), the lower boiling fraction will be essentially sulfur-free since the lowest boiling sulfur component remaining after the oxidation of the mercaptans will be thiophene, boiling at 183° F. (84° C.). The lower boiling fraction may then be blended directly into the refinery gasoline pool. Higher cut points will reduce the hydrogen consumption during the hydrodesulfurization and may be selected depending on the permissible sulfur levels final product and this, in turn, will depend on the sulfur content of the other components in the gasoline pool. Usually, the cut point will be no higher than 285° F. (about 141° C.) to ensure that heavier thiophenes do not pass into the final gasoline but rather, onto the hydrogenative desulfurization of the back end. Operation of the fractionator under reduced pressure will enable the distillation to be carried out at a lower temperature, reducing the potential for thermal decomposition of the disulfides to reform mercaptans which would then pass into the light cut.

Hydrodesulfurization

The hydrodesulfurization of the higher boiling fraction is carried out in the conventional manner with a hydrotreating catalyst under conditions which result in the separation of at least some of the sulfur from the feed molecules and its conversion to hydrogen sulfide, to produce a hydrotreated intermediate product comprising a normally liquid fraction boiling in substantially the same boiling range as the feed to this step but with a lower combined (organic) sulfur content and a lower octane number as a consequence of the olefin saturation which takes place.

The temperature of the hydrotreating step is suitably from about 400° to 850° F. (about 220° to 454° C.), preferably about 500° to 800° F. (about 260° to 427° C.) with the exact selection dependent on the desulfurization desired for a given feed and catalyst. These temperatures are average bed temperatures and will, of course, vary according to the feed and other reaction paramenters including, for example, hydrogen pressure and catalyst activity.

The conditions in the hydrotreating reactor should be adjusted not only to obtain the desired degree of desulfurization in the higher boiling fraction. When operating in cascade mode (no interstage separation or heating) they may also be selected to produce the required inlet temperature for the second step of the process so as to promote the desired shape-selective cracking reactions in this step. A temperature rise of about 20° to 200° F. (about 11° to 111° C.) is typical under most hydrotreating conditions and with reactor inlet temperatures in the preferred 500° to 800° F. (260° to 427° C.) range, will normally provide a requisite initial temperature for cascading to the octane restoration step which, as note below, is endothermic. When operated inthe two-stage configuration with interstage separation and heating, control of the first stage exotherm is obviously not as critical; two-stage operation may be preferred since it offers the capability of decoupling and optimizing the temperature requirements of the individual stages.

Since the feeds are usually desulfurized without undue difficulty, low to moderate pressures may be used, typically from about 50 to 1500 psig (about 445 to 10443 kPa), preferably about 300 to 1000 psig (about 2170 to 7,000 kPa). Pressures are total system pressure, reactor inlet. Pressure will normally be chosen to maintain the desired aging rate for the catalyst in use. The space velocity for the hydrodesulfurization step overall is typically about 0.5 to 10 LHSV ($hr^{-1}$), preferably about 1 to 6 LHSV ($hr^{-1}$), based on the toal feed and the total catalyst volume although the space velocity will vary along the length of the reactor as a result of the stepwise introduction of the feed. The hydrogen to hydrocarbon ratio in the feed is typically about 500 to 5000 SCF/Bbl (about 90 to 900 $n.l.l^{-1}$.), usually about 1000 to 2500 SCF/B (about 180 to 445 $n.l.l^{-1}$.), again based on the total feed to hydrogen volumes. The extent of the desulfurization will depend on the sulfur content of the higher boiling fraction and, of course, on the product sulfur specification, with the reaction parameters to be selected accordingly. It is not necessary to go to very low nitrogen levels but low nitrogen levels may improve the activity of the catalyst in the second step of the process. Normally, the denitrogenation which accompanies the desulfurization will result in an acceptable organic nitrogen content in the feed to the second step of the process; if it is necessary, however, to increase the denitrogenation in order to obtain a desired level of activity in the octane restoration step, the operating conditions in the first step may be adjusted accordingly.

The catalyst used in the hydrodesulfurization is suitably a conventional desulfurization catalyst made up of a Group VI and/or a Group VIII metal on a suitable substrate. The Group VI metal is usually molybdenum or tungsten and the Group VIII metal usually nickel or cobalt. Combinations such as Ni-Mo or Co-Mo are typical. Other metals which possess hydrogenation functionality are also useful in this service. The support for the catalyst is conventionally a porous solid, usually alumina, or silica-alumina but other porous solids such as magnesia, titania or silica, either alone or mixed with alumina or silica-alumina may also be used, as convenient.

A change in the volume of gasoline boiling range material typically takes place in the hydrodesulfurization. Although some decrease in volume occurs as the result of the conversion to lower boiling products ($C_5-$), the conversion to $C_5-$ products is typically not more than 5 vol percent and usually below 3 vol percent and is normally compensated for by the increase which takes place as a result of aromatics saturation. An increase in volume is typical for the octane restoration step where, as the result of cracking the back end of the hydrotreated feed, cracking products within the gasoline boiling range are produced. An overall increase in volume of the gasoline boiling range ($C_5+$) materials may occur. The process should normally be operated under a combination of conditions such that the desulfurization should be at least about 50%, preferably at least about 75%, as compared to the sulfur content of the feed.

It is possible to take a selected fraction of the hydrotreated, desulfurized intermediate product and pass it to alternative processing. A process configuration with potential advantages, for example, is to take a lower boiling cut, such as a 195°-302° F. (90°-150° C.) fraction, from the hydrodesulfurized effluent and send it to the reformer where the low octane naphthenes which make up a significant portion of this fraction are converted to high octane aromatics. The heavy portion of the hydrodesulfurized effluent is, however, sent to the octane restoration step where controlled shape-selective cracking takes place. The hydrotreatment in the previous stage is effective to desulfurize and denitrogenate the catalytically cracked naphtha which permits this light cut to be processed in the reformer.

Octane Restoration

After the hydrotreating step, the desulfurized effluent from the hydrodesulfurization unit is passed to the octane restoration step in which cracking takes place in the presence of the acidic functioning catalyst to restore the octane lost in the hydrodesulfurization of the higher boiling fraction. In this step, the hydrotreated intermediate product is treated by contact with an acidic catalyst under conditions which produce a second product which boils in the gasoline boiling range and which has a higher octane number than the hydrotreated intermediate product.

The conditions used in the second step of the process are those which result in a controlled degree of shape-selective cracking of the desulfurized, effluents from the desulfurization steps. This controlled cracking produces olefins which restore the octane rating of the original, cracked feed at least to a partial degree. The reactions which take place during this step are mainly the shape-selective cracking of low octane paraffins to form higher octane products, both by the selective cracking of heavy paraffins to lighter paraffins and the cracking of low octane n-paraffins, in both cases with the generation of olefins. Some isomerization of n-paraffins to branched-chain paraffins of higher octane may take place, making a further contribution to the octane of the final product. In favorable cases, the original octane rating of the feed may be completely restored or perhaps even exceeded. Since the volume of the second stage product will typically be comparable to that of the original feed or even exceed it, the number of octane barrels (octane rating x volume) of the final, desulfurized product may exceed the octane barrels of the feed.

The conditions used in the second step are those which are appropriate to produce this controlled degree of cracking. Typically, the temperature of the second step will be about 300° to 900° F. (about 150° to 480° C.), preferably about 350° to 800° F. (about 177° C.). As mentioned above, however, a convenient mode of operation is to cascade the hydrotreated effluent into the second reaction zone and this will imply that the outlet temperature from the first step will set the initial temperature for the second zone. The feed characteristics and the inlet temperature of the hydrotreating zone, coupled with the conditions used in the first stage will set the first stage exotherm and, therefore, the initial temperature of the second zone. Thus, the process can be operated in a completely integrated manner, as shown below.

The pressure in the second reaction zone is not critical since no hydrogenation is desired at this point in the sequence although a lower pressure in this stage will tend to favor olefin production with a consequent favorable effect on product octane. The pressure will therefore depend mostly on operating convenience and will typically be comparable to that used in the first stage, particularly if cascade operation is used. Thus, the pressure will typically be about 50 to 1500 psig (about 445 to 10445 kPa), preferably about 300 to 1000 psig (about 2170 to 7000 kPa) with comparable space velocities, typically from about 0.5 to 10 LHSV ($hr^{-1}$), normally about 1 to 6 LHSV ($hr^{-1}$). Hydrogen 1to hydrocarbon ratios typically of about 0 to 5000 SCF/Bbl (0 to 890 $n.l.l^{-1}$.), preferably about 100 to 2500 SCF/Bbl (about 18 to 445 n.l.l$^{-1}$.) will be selected to minimize catalyst aging. No significant degree of hydrogen consumption takes place in this step, i.e. hydrogen consumption is less than 200 SCF/Bbl (about 35 n.l.l$^{-1}$.).

The use of relatively lower hydrogen pressures thermodynamically favors the increase in volume which occurs in the second step and for this reason, overall lower pressures are preferred if this can be accommodated by the constraints on the aging of the two catalysts. In the cascade mode, the pressure in the second step may be constrained by the requirements of the first but in the two-stage mode the possibility of recompression permits the pressure requirements to be individually selected, affording the potential for optimizing conditions in each stage.

Consistent with the objective of restoring lost octane while retaining overall product volume, the conversion to products boiling below the gasoline boiling range ($C_5$−) during the second stage is held to a minimum. However, because the cracking of the heavier portions of the feed may lead to the production of products still within the gasoline range, no net conversion to $C_5$− products may take place and, in fact, a net increase in $C_5$+ material may occur during this stage of the process, particularly if the feed includes significant amount of the higher boiling fractions. It is for this reason that the use of the higher boiling naphthas is favored, especially the fractions with 95 percent points above about 350° F. (about 177° C.) and even more preferably above about 380° F. (about 193° C.) or higher, for instance, above about 400° F. (about 205° C.). Normally, however, the 95 percent point will not exceed about 520° F. (about 270° C.) and usually will be not more than about 500° F. (about 260° C.).

The catalyst used in the second step of the process possesses sufficient acidic functionality to bring about the desired cracking reactions to restore the octane lost in the hydrotreating step. The preferred catalysts for this purpose are the intermediate pore size zeolitic behaving catalytic materials are exemplified by those acid acting material s having the topology of intermediate pore size aluminosilicate zeolites. These zeolitic catalytic materials are exemplified by those which, in their aluminosilicate form would have a Constraint Index between about 2 and 12. Reference is here made to U.S. Pat. No. 4,784,745 for a definition of Constraint Index and a description of how this value is measured. This patent also discloses a substantial number of catalytic materials having the appropriate topology and the pore system structure to be useful in this service.

The preferred intermediate pore size aluminosilicate zeolites are those having the topology of ZSM-5, ZSM-11, ZSM-12, ZSM-21, ZSM-22, ZSM-23, ZSM-35, ZSM-48, ZSM-50 or MCM-22. Zeolite MCM-22 is described in U.S. Pat. Nos. 4,962,256 and 4,954,325 to which reference is made for a description of this zeolite and its preparation and properties. Other catalytic materials having the appropriate acidic functionality may, however, be employed. A particular class of catalytic materials which may be used are, for example, the large pores size zeolite materials which have a Constraint Index of up to about 2 (in the aluminosilicate form). Zeolites of this type include mordenite, zeolite beta, faujasites such as zeolite Y and ZSM-4.

These materials are exemplary of the topology and pore structure of suitable acid-acting refractory solids; useful catalysts are not confined to the aluminosilicates and other refractory solid materials which have the desired acid activity, pore structure and topology may also be used. The zeolite designations referred to above, for example, define the topology only and do not restrict the compositions of the zeolitic-behaving catalytic components. Metallosilicates other than aluminosilicates may, for example, be used e.g. materials with boron, iron or gallium components; for convenience these materials are comprehended within the scope of the term "zeolite" when they have the same topology.

The catalyst should have sufficient acid activity to have cracking activity with respect to the second stage feed (the intermediate fraction), that is sufficient to convert the appropriate portion of this material as feed. One measure of the acid activity of a catalyst is its alpha number, as discussed in application Ser. Nos. 07/745,311 and 07/850,106, to which reference is made for a description of the alpha characterization. The catalyst used in the second step of the process suitably has an alpha activity of at least about 20, usually in the range of 20 to 800 and preferably at least about 50 to 200. It is inappropriate for this catalyst to have too high an acid activity because it is desirable to only crack and rearrange so much of the intermediate product as is necessary to restore lost octane without severely reducing the volume of the gasoline boiling range product.

The active component of the catalyst e.g. the zeolite will usually be used in combination with a binder or substrate because the particle sizes of the pure zeolitic behaving materials are too small and lead to an excessive pressure drop in a catalyst bed. This binder or substrate, which is preferably used in this service, is suitably any refractory binder material. Examples of these materials are well known and typically include silica, silica-alumina, silica-zirconia, silica-titania, alumina.

The catalyst used in this step of the process may contain a metal hydrogenation function for improving catalyst aging or regenerability; on the other hand, depending on the feed characteristics, process configuration (cascade or two-stage) and operating parameters, the presence of a metal hydrogenation function may be undesirable if it tends to promote saturation of olefinics produced in the cracking reactions. If found to be desirable under the actual conditions used with particular feeds, metals such as the Group VIII base metals or combinations will normally be found suitable, for example nickel. Noble metals such as platinum or palladium will normally offer no advantage over nickel. A nickel content of about 0.5 to about 5 weight percent is suitable.

The particle size and the nature of the second conversion catalyst will usually be determined by the type of conversion process which is being carried out and will normally be operated as a a down-flow, liquid or mixed phase, fixed bed process or as an an up-flow, fixed bed, liquid or mixed phase process.

The conditions of operation and the catalysts should be selected, together with appropriate feed characteristics to result in a product slate in which the gasoline product octane is not substantially lower than the octane of the feed gasoline boiling range material; that is not lower by more than about 1 to 3 octane numbers. It is preferred also that the volumetric yield of the product is not substantially diminished relative to the feed. In some cases, the volumetric yield and/or octane of the gasoline boiling range product may well be higher than those of the feed, as noted above and in favorable cases, the octane barrels (that is the octane number of the product times the volume of product) of the product will be higher than the octane barrels of the feed. Increases in the volumetric yield of the gasoline boiling range fraction of the product, and possibly also of the octane number (particularly the motor octane number), may be obtained by using $C_3$–$C_4$ cracking products from the octane restoration step as feed for an alkylation process to produce alkylate of high octane number. The light ends from this step are particularly suitable for this purpose since they are olefinic as a result of the cracking which takes place at this time. Alternatively, the olefinic light ends from the octane restoration step may be used as feed to an etherification process to produce ethers such as MTBE or TAME for use as oxygenate fuel components. Depending on the composition of the light ends, especially the paraffin/olefin ratio, alkylation may be carried out with additional alkylation feed, suitably with isobutane which has been made in this or a catalytic cracking process or which is imported from other operations, to convert at least some preferably a substantial proportion, to high octane alkylate in the gasoline boiling range, to increase both the octane and the volumetric yield of the total gasoline product.

With a full range naphtha feed, the hydrodesulfurization operation will reduce the octane number of the gasoline boiling range fraction of the first intermediate product by at least about 5%, and, if the sulfur content is high in the feed, that this octane reduction could go as high as about 15%. The selective cracking step should be operated under a combination of conditions such that at least about half (½) of the octane lost in the first stage operation will be recovered, preferably such that all of the lost octane will be recovered, most preferably that the second stage will be operated such that there is a net gain of at least about 1% in octane over that of the feed, which is about equivalent to a gain of about at least about 5% based on the octane of the hydrotreated intermediate.

The olefins produced by the shape-selective cracking reactions in this step of the process tend to undergo recombination with the hydrogen sulfide produced in the preceding hydrotreating step if the inorganic sulfur is not removed in an interstage separation. These recombination reactions produce mercaptan sulfur compounds according to the equation:

$$R{-}CH{=}CH_2 + H_2S \longrightarrow R{-}\underset{\underset{SH}{|}}{CH}{-}CH_2$$

These mercaptan compounds may be present in sufficient amounts for the final gasoline product to fail the doctor sweet test or the copper strip corrosion test but they may be readily removed by a final desulfurization to reduce the mercaptan sulfur to acceptable levels. A mercaptan extraction process is suitable for this purpose because it may be readily combined with is the mercaptan oxidation process used on the front end and, in addition, does not produce any saturation of the olefins formed in the octane restoration step. An alternative is a mild hydrotreating, at the cost of some olefin saturation or, alternatively, a mercaptan oxidation as decribed above provided that total product sulfur levels can be attained if this is done.

The amount of mercaptan sulfur produced by the recombination reactions will depend, of course, not only on the amount of sulfur initially present in the higher boiling fraction but also on the degree of cracking which is encountered in the octane-restoration step. In cases where the intermediate product contains a relatively low level of mercaptans, a higher proportion of the product from the octane-restoration step may by-pass the mercaptan removal unit and enter the gasoline pool directly without further treatment. Normally, however, it will be convenient for the entire effluent to pass through the mercaptan removal unit.

The use of the mercaptan oxidation before the hydrotreating step eliminates the need for an extractive type unit at this stage of the processing. The separation of the olefins from the sulfur components by the transfer to the back end after the oxidation step also permits the desulfurization efforts to be concentrated on the back end, where most of the sulfur components are in the first place. Another advantage is that the light and heavy cuts remain separate after the distillation, giving flexibility in blending without the need for any further product splitting.

EXAMPLE

The following Example illustrates the process, where a 65°–455° F. (18°–235° C.) catalytically cracked naphtha is treated to give a substantially desulfurized product with minimal octane loss.

The sulfur compounds in this cracked naphtha are predominantly thiophenes and light mercaptans due to the nature of the cracking process. The cracked naphtha also contains a high concentration of olefins, which contribute substantially to the octane. The high olefin concentration is reflected in the high bromine number. The properties of this naphtha are shown in Table 2 below.

TABLE 2

| | FCC Naphtha Properties | | |
|---|---|---|---|
| | Full Range | Light Fraction | Heavy Fraction |
| Boiling Range, °F. | 65–455 | 65–285 | 285–455 |
| Fraction of Full Range FCC Naphtha | | | |
| (wt %) | 100 | 71.0 | 29.0 |
| (vol %) | 100 | 73.8 | 26.2 |
| API Gravity | 55.1 | 62.5 | 37.0 |
| Mercaptan Sulfur $C_2$–$C_5$, ppmw | 41 | 58 | 0 |
| Total Sulfur, ppmw | 1240 | 200 | 3800 |
| Bromine Number | 79.15 | 94.89 | 40.62 |
| Nitrogen, ppmw | 19 | 6 | 51 |
| Research Octane | 92.0 | 93.0 | 89.1 |
| Motor Octane | 80.4 | 81.1 | 78.3 |

The full range naphtha is first treated by a mercaptan oxidation process. The $C_2$–$C_5$ mercaptans are readily converted to disufides and shift into the higher 285° F.+ (about 141° C.+) boiling range. The product from the mercaptan oxidation is then distilled into light and heavy fractions. The light fraction boiling below 285° F. (141° C.) retains most of the high octane olefins, is essentially sulfur-free, and can be blended directly into the gasoline pool.

The heavy fraction (285°–455° F., 141°–235° C.) was treated in a two stage process to remove sulfur and restore octane. The first hydrodesulfurization stage used a conventional cobalt-molybdenum hydrotreating catalyst, while the second cracking stage restored octane with ZSM-5 catalyst. The properties of the catalysts used in this process are shown in Table 3 below.

TABLE 3

| | Catalyst Properties | |
|---|---|---|
| | Hydrodesulfurization 1st stage Catalyst | ZSM-(1) 2nd stage Catalyst |
| Chemical Composition, wt % | | |
| Nickel | — | |
| Cobalt | 3.4 | — |
| $MoO_3$ | 15.3 | — |
| Physical Properties | | |
| Particle Density, g/cc | — | 0.929 |
| Surface Areas, $m^2/g$ | 260 | 324 |
| Pore Volume, cc/g | 0.55 | 0.699 |
| Pore Diameter, A | 85 | — |

(1)contains 65 wt % ZSM-5 and 35 wt % alumina

Both stages of the treatment were carried out in an isothermal pilot plant with direct cascade of the first stage effluent to the second stage, without interstage separation of the intermediate products of hydrogen sulfide and ammonia. The ratio of catalyst volumes used in the first and second stages was 1:2 by volume. The pilot plant operated at the following conditions for both stages: 600 psig, space velocity of 0.67 LHSV, a hydrogen circulation rate of 2000 SCF/Bbl (4240 kPa abs, 1 $hr^{-1}$ LHSV, 356 n.l.l.$^{-1}$).

Properties and yields obtained by treating the heavy fraction with the method described above are shown in Table 4 below. The first hydrogesulfurization stage removed the thiophenic sulfur compounds, but a substantial octane loss occurred due to olefin saturation. The second cracking stage restored the octane by selectively cracking low octane paraffins, and generating olefins. Although mercaptans were also formed in the cracking stage from hydrogen sulfide, which is an intermediate product from the first stage, the heavy fraction was substantially desulfurized, with minimal octane loss

TABLE 4

Hydrodesulfurization and ZSM-5 Upgrading of Heavy FCC Naphtha Fraction

| | |
|---|---|
| Stage 1 Temp., °F. (°C.) | 770 (410) |
| Stage 2 Temp., °F. (°C.) | 700 (370) |
| Feed | |
| Boiling Range, °F. (°C.) | 285–455 (140–235) |
| API Gravity | 37.0 |
| Mercaptan Sulfur $C_2$–$C_5$, ppmw | 0 |
| Total Sulfur, ppmw | 3800 |
| Nitrogen, ppmw | 51 |
| Bromine Number | 40.62 |
| Research Octane | 89.1 |
| Motor Octane | 78.3 |
| Wt % $C_5$+ | 100.0 |
| Vol % $C_5$+ | 100.0 |
| Stage 1 Product | |
| Mercaptan Sulfur $C_2$–$C_5$, ppmw | 1 |
| Total Sulfur, ppmw | 3 |
| Nitrogen, ppmw | <1 |
| Bromine Number | 0.51 |
| Research Octane | 75.3 |
| Motor Octane | 68.3 |
| Wt % $C_5$+ | 99.7 |
| Vol % $C_5$+ | 101.5 |
| Vol % $C_3$ Olefins | 0.0 |
| Vol % $C_4$ Olefins | 0.0 |
| Vol % Isobutane | 0.0 |
| Potential Alkylate, Vol %[1] | 0.0 |
| Stage 2 Product | |
| Mercaptan Sulfur $C_2$–$C_5$, ppmw | 91 |
| Total Sulfur, ppmw | 100 |
| Nitrogen, ppmw | <1 |
| Bromine No. | 2.75 |

TABLE 4-continued

Hydrodesulfurization and ZSM-5 Upgrading of Heavy FCC Naphtha Fraction

| | |
|---|---|
| Research Octane | 85.5 |
| Motor octane | 77.3 |
| Wt % $C_5$+ | 95.4 |
| Vol % $C_5$+ | 96.8 |
| Vol % $C_3$ Olefins | 0.4 |
| Vol % $C_4$ Olefins | 0.9 |
| Vol % Isobutane | 1.6 |
| Potential Alkylate, vol %[1] | 2.2 |

[1]Potential alkylate defined as 1.7 × ($C_4$ = +$C_3$, vol %

A lower total product sulfur and mercaptan concentration in the treated heavy fraction could be obtained by further treating the product with an extractive type process to remove the remaining mercaptans to a concentration less than 5 ppmw. Since the mercaptans are predominantly $C_2$–$C_5$, they are easily removed with conventional processes while preserving the product olefins and octane. Alternatively, mild post hydrotreating may be used to remove the mercaptans but with some octane loss due to olefin saturation. The severity in the octane-restoration step could be increased to offset this loss.

We claim:

1. A process of upgrading a sulfur-containing cracked feed in the gasoline boiling range containing a first, relatively low boiling, portion containing sulfur components and a second, relatively high boiling portion containing sulfur components, which comprises:

transferring the sulfur components from the first portion to the second portion of the cracked feed to form a first intermediate product, fractionating the intermediate product to form (i) a first fraction in the gasoline boiling range and (ii) a second fraction in the gasline boiling range which boils above the first fraction and which comprises the sulfur components of the second portion of the cracked feed and the sulfur components transferred from the first portion of the cracked feed, hydrodesulfurizing the second fraction in the presence of a hydrodesulfurization catalyst under conditions of elevated temperature, elevated pressure and in an atmosphere comprising hydrogen, to produce a desulfurized intermediate product;

contacting the desulfurized intermediate product with a catalyst of acidic functionality to convert it to a second product comprising a fraction boiling in the gasoline boiling range having a higher octane number than the gasoline boiling range fraction of the desulfurized first intermediate product.

2. The process as claimed in claim 1 in which the sulfur components of the first portion of the cracked feed comprising mercaptans are transferred from the first portion to the second portion of the cracked feed by oxidation of the mercaptans to form disulfides.

3. The process of claim 2 in which the mercaptans are oxidized to disulfides by oxidation with air in the presence of an oxidation catalyst comprising a chelate of an iron-group metal.

4. The process of claim 1 which includes the step of desulfurizing the second product to remove mercaptan sulfur and blending the desulfurized second product with the first fraction.

5. The process as claimed in claim 4 in which the second product is desulfurized to remove mercaptan sulfur by a non-hydrogenative mercaptan extraction process.

6. The process as claimed in claim 4 in which the second product is hydrodesulfurized to remove mercaptan sulfur.

7. The process as claimed in claim 1 in which the the intermediate product is fractionated at a cut point in the range of 150° to 285° F. to form the first fraction and the second fraction.

8. The process as claimed in claim 1 in which the the intermediate product is fractionated at a cut point in the range of 170° to 230° F. to form the first fraction and the second fraction.

9. The process as claimed in claim 1 which incudes the step of blending the first fraction and the second product to form a desulfurized gasoline product.

10. A process as claimed in claim 1 in which the desulfurized intermediate product is contacted with a crystalline zeolite catalyst of acidic functionality to convert it to the second product.

11. A process of upgrading a sulfur-containing catalytically cracked naphtha feed comprising olefins and containing a first, lower boiling, portion containing mercaptan sulfur components and a second, higher boiling portion containing higher boiling sulfur components, which comprises:

oxidizing the mercaptan sulfur components from the first portion to form higher boiling disulfides which boil in the boiling range of the second portion of the cracked feed, to form a first intermediate product, fractionating the intermediate product at a cut point in the range of 150° to 285° F. to form (i) a first fraction in the gasoline boiling range and (ii) a second fraction in the gasoline boiling range which boils above the first fraction and which comprises the disulfides and the sulfur components of the second portion of the cracked feed, hydrodesulfurizing the second fraction in the presence of a hydrodesulfurization catalyst under conditions of elevated temperature, elevated pressure and in an atmosphere comprising hydrogen, to produce a desulfurized intermediate product;

contacting the desulfurized intermediate product with an acidic zeolite catalyst to convert it to a second product comprising a fraction boiling in the gasoline boiling range having a higher octane number than the gasoline boiling range fraction of the desulfurized first intermediate product.

12. The process of claim 11 which includes the step of desulfurizing the second product to remove mercaptan sulfur and blending the desulfurized second product with the first fraction.

13. The process as claimed in claim 11 in which the second product is desulfurized by a non-hydrogenative mercaptan extraction process before it is blended with the first fraction.

14. The process as claimed in claim 12 in which the second product is hydrodesulfurized to remove mercaptan sulfur before it is blended with the first fraction.

15. The process as claimed in claim 11 in which the the intermediate product is fractionated at a cut point in the range of 170° to 240° F. to form the first fraction and the second fraction.

16. The process as claimed in claim 11 which incudes the step of blending the first fraction and the second product to form a desulfurized gasoline product.

17. A process as claimed in claim 11 in which the desulfurized intermediate product is contacted with a crystalline zeolite catalyst of acidic functionality to convert it to the second product.

18. The process as claimed in claim 17 in which the acidic catalyst comprises an intermediate pore size zeolite in the aluminosilicate form.

19. The process as claimed in claim 15 in which the intermediate pore size zeolite has the topology of ZSM-5.

20. The process as claimed in claim 17 in which the intermediate pore size zeolite has the topology of MCM-22.

21. The process as claimed in claim 17 in which the intermediate pore size zeolite has the topology of zeolite beta.

22. The process as claimed in claim 11 in which the cracked feed comprises a full range naphtha fraction having a boiling range within the range of $C_5$ to 420° F.

23. The process as claimed in claim 11 in which said feed fraction comprises a naphtha fraction having a 95 percent point of at least about 350° F.

24. The process as claimed in claim 11 in which said feed fraction comprises a naphtha fraction having a 95 percent point of at least about 380° F.

25. The process as claimed in claim 11 in which the hydrodesulfurization of the second fraction is carried out at a temperature of about 400° to 800° F., a pressure of about 50 to 1500 psig, a space velocity of about 0.5 to 10 LHSV (based on total hydrocarbon feed), and a hydrogen to hydrocarbon ratio of about 500 to 5000 standard cubic feet of hydrogen per barrel of total feed.

* * * * *